US010553944B2

(12) United States Patent
Apostolos et al.

(10) Patent No.: US 10,553,944 B2
(45) Date of Patent: Feb. 4, 2020

(54) SLOT LINE VOLUMETRIC ANTENNA

(71) Applicant: AMI Research & Development, LLC, Windham, NH (US)

(72) Inventors: John T. Apostolos, Lyndeborough, NH (US); William Mouyos, Windham, NH (US); Judy Feng, Nashua, NH (US)

(73) Assignee: AMI Research & Development, LLC, Windham, NH (US)

( * ) Notice: Subject to any disclaimer, the term of this patent is extended or adjusted under 35 U.S.C. 154(b) by 0 days.

(21) Appl. No.: 15/903,132

(22) Filed: Feb. 23, 2018

(65) Prior Publication Data

US 2018/0287253 A1 Oct. 4, 2018

Related U.S. Application Data

(63) Continuation-in-part of application No. 15/362,988, filed on Nov. 29, 2016, now Pat. No. 10,135,122.

(60) Provisional application No. 62/463,086, filed on Feb. 24, 2017.

(51) Int. Cl.

| | |
|---|---|
| ***H01Q 1/24*** | (2006.01) |
| ***H01Q 3/24*** | (2006.01) |
| ***H01Q 21/24*** | (2006.01) |
| ***H01Q 5/45*** | (2015.01) |
| ***H01Q 9/28*** | (2006.01) |
| ***H01Q 5/48*** | (2015.01) |

(52) U.S. Cl.

CPC ..... *H01Q 3/247* (2013.01); *H01Q 1/245* (2013.01); *H01Q 5/45* (2015.01); *H01Q 5/48* (2015.01); *H01Q 9/285* (2013.01); *H01Q 21/245* (2013.01)

(58) Field of Classification Search

CPC ..... H01Q 3/247; H01Q 13/10; H01Q 25/001; H01Q 25/00; H01Q 1/2291; H01Q 21/28; H01Q 21/26; H01Q 21/205; H01Q 21/08; H01Q 5/45; H01Q 5/48; H01Q 1/245; H01Q 9/285; H01Q 21/245

See application file for complete search history.

(56) References Cited

U.S. PATENT DOCUMENTS

| | | | | |
|---|---|---|---|---|
| 6,057,802 | A * | 5/2000 | Nealy | H01Q 9/0407 343/700 MS |
| 6,765,537 | B1 | 7/2004 | Apostolos | |
| 2002/0122006 | A1 | 9/2002 | Crawford | |
| 2005/0242959 | A1 | 11/2005 | Watanabe | |
| 2009/0073049 | A1 * | 3/2009 | Apostolos | H01Q 1/3275 343/700 MS |
| 2013/0257668 | A1 | 10/2013 | Rao et al. | |
| 2013/0273858 | A1 | 10/2013 | Sover et al. | |
| 2014/0176385 | A1 * | 6/2014 | Apostolos | H01Q 1/36 343/790 |

OTHER PUBLICATIONS

International Search Report and Written Opinion dated Jul. 23, 2018 for International Application No. PCT/US2018/01923 filed Feb. 23, 2018.

* cited by examiner

*Primary Examiner* — Jessica Han
*Assistant Examiner* — Awat M Salih
(74) *Attorney, Agent, or Firm* — David J. Thibodeau, Jr.; VLP Law Group LLP

(57) ABSTRACT

A slot fed volumetric antenna structure that activates antenna beams in three axes by selective connection of feedpoints.

6 Claims, 9 Drawing Sheets

| FEEDPOINTS | FIELD DIRECTION |
|---|---|
| E F | Y AXIS |
| A B | Z AXIS |
| C D | X AXIS |

| FEEDPOINTS | FIELD DIRECTION |
|---|---|
| E F | Y AXIS |
| A B | Z AXIS |
| C D | X AXIS |

801-B

801-A

| Switch Positions | | Polarization | Propagation Direction |
|---|---|---|---|
| 2 | 1 | $H_{pol}$<br>$V_{pol}$ | →<br>↑ |
| 1 | 2 | $H_{pol}$<br>$V_{pol}$ | ↑<br>→ |
| 90° | 90° | RH $C_{pol}$ | |
| -90° | -90° | LH $C_{pol}$ | |

SLOT LINE VOLUMETRIC ANTENNA

CROSS REFERENCE TO RELATED APPLICATIONS

This application claims priority to a U.S. Provisional Patent Application Ser. No. 62/463,086 filed Feb. 24, 2017 entitled "Slot Line OMAN Antenna" and is also related to co-pending U.S. patent application Ser. No. 15/362,988 filed Nov. 29, 2016 entitled "Super Directive Array of Volumetric Antenna Elements for Wireless Device Applications". The entire contents of each of these applications is hereby incorporated by reference.

BACKGROUND

Technical Field

This application relates to wireless communication and in particular to a volumetric antenna element with a controllable beam direction.

Background Information

An important consideration in the design of a wireless device is the antenna. The operating frequency, bandwidth, size constraints, and likelihood of perturbation by the surrounding environment often dictate the antenna configuration. Handheld wireless devices such as cellular telephones have typically used a monopole antenna. However, the gain of a monopole antenna is noticeably reduced by the proximity of a nearby human user. A directional antenna, or beam antenna, radiates or receives greater power in one or more specified directions. Directional antennas thus allow for increased performance and reduced interference from unwanted sources.

One way to implement a directional antenna is with a phased array. A phased array includes a number of geometrically arranged radiating elements with a deliberate phase relationship. Phase shifts applied to the different elements are varied in order to steer the beam's directional pattern without the use of moving parts. So-called smart antennas are another application of phased arrays, where a digital signal processor may compute phase shifts on the fly.

Government regulatory authorities such as the United States Federal Communications Commission (FCC) specify a maximum Specific Absorption Rate (SAR) for radiation emitted from wireless devices. Such regulations, as well as a general concern over potentially adverse health effects resulting from concentrated radio frequency emissions, have limited the widespread adoption of directional antennas. Smart phones, tablets, and similar wireless devices must of course comply with established radio frequency emission limits.

Recent developments in Internet of Things (IoT) devices presage a future where billions of objects have access to the Internet via wireless networks. The ever present push for internetworking physical devices, vehicles, buildings and other items that have embedded electronics, software, sensors, and actuators will enable many different types of objects to collect and exchange data. This trend will increasingly demand that wireless devices selectively communicate, to avoid unnecessary interference, and reduce competition for use of the limited available wireless spectrum.

Certain types of directional antennas as described in the above-referenced co-pending patent application Ser. No. 15/362,988 entitled "Super Directive Array of Volumetric Antenna Elements for Wireless Device Applications" are generally configured as a pair of crossed dipoles formed from four patch elements. Such antenna elements may be folded over, and are thus particularly well suited for mounting along the edges of wireless devices such as cell phones, tablets, and laptop computers.

SUMMARY

The volumetric antenna element described herein may be configured to provide directive radiation along one or more axes and over multiple polarizations.

More particularly, the volumetric elements may each circumscribe a three-dimensional space. In one design, the volumetric elements include planar, rectangular radiators that consist of patches of conductive material. Two conductive material patches may be placed along a first (or "top") plane. Other patches are placed in two adjacent perpendicular (or "side") planes located on either side of the first plane, spaced apart from the top patches by a gap or slot. The patches thus generally form a "u" shape in cross section that circumscribes a volume. An inductor is placed across one end of the top patches and a stub across the opposite end.

In some implementations, four conductive patches may be placed in the top plane, each of the patches separated from the others by a slot.

Selective connection of feed points to the top and side plane elements activate a radiation beam along one of three axes.

In other aspects, multiple such volumetric antenna elements may be arranged connected as a driven element or a parasitic element. In one such implementation, three volumetric elements are disposed on each side of the housing, the center element is a driven element, and parasitic elements are placed on either side of the center driven element. In this implementation, the parasitic elements may be controllable to be reflective or directive, such as by tuning their respective resonant frequencies lower or higher than the center driven element. Selectively driving the parasitic elements may also provide Multiple Input/Multiple Output (MIMO) operation.

In some arrangements, the elements may each be a pair of crossed dipoles, or even two or more pairs of crossed dipoles. In these implementations, the crossed dipoles may be coupled to combining circuit that can selectively provide different polarizations. Circular, horizontal, and/or vertical polarizations may be provided by selectable feed networks.

In one embodiment, the volumetric antenna element is disposed within a wireless device. The wireless device may include a rectangular housing with a front face, a back face, and four sides or edges. The device may be of the familiar "bar" form factor such as an Apple™ iPhone™ or Android™ smartphone. Along one side of the housing are placed one or more of the volumetric antenna elements. In this configuration, the volumetric elements circumscribe a volume that not only encompasses a space along the edge of the housing, but also encompasses a space that reaches into the body of the device.

BRIEF DESCRIPTION OF THE DRAWINGS

The description below refers to the accompanying drawings, of which.

DETAILED DESCRIPTION OF AN ILLUSTRATIVE EMBODIMENT

Figure 1B:
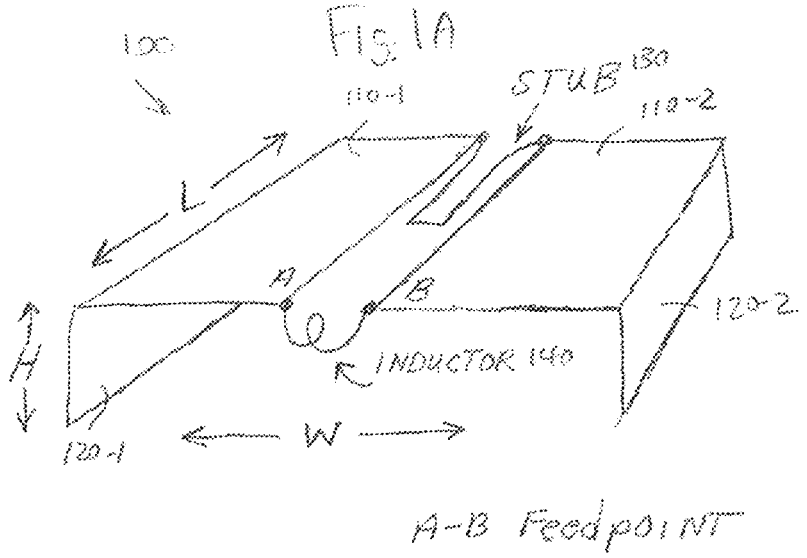
FIG. 1 illustrates a basic slot line element.
Figure 1B:
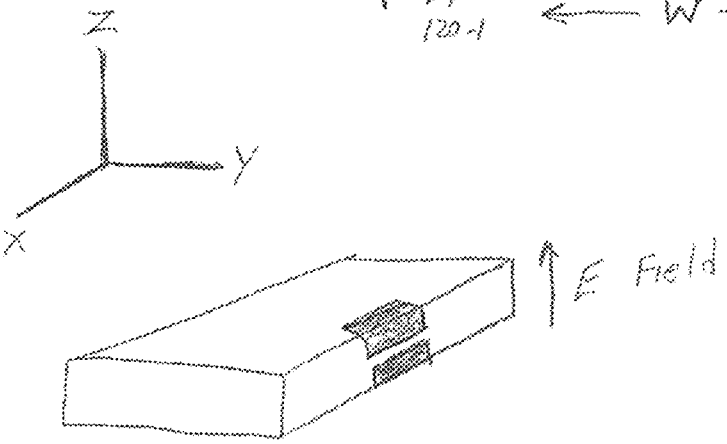

One example implementation of a slot line antenna element 100 is shown on the upper right of FIG. 1A. A pair of conductive material patches 110-1, 110-2 disposed in a first plane are spaced apart by a slot. Each patch is folded over in an L-shape, such that a other conductive sections 120-1, 120-2 are located in another, preferably perpendicular or orthogonal plane. The patches 110-1, 120-1 mirror patches 110-2, 120-2. The patches may be r, typically to conform to the edge of a device housing, as shown in the middle of the figure. A first feed point A is provided at one end of one patch 110-1, and a second feed point B is provided on the other patch 110-2. Length L is typically 0.2 wavelengths, while height H and width W are in the 0.1 wavelength range.

The volumetric slot line element 100 may include a hairpin stub 130 on the end opposite the A,B feedpoints, which extends the effective length to ¼ wavelengths. An inductor 140 placed across the feedpoints helps resonate the element 100 and to match the impedance, such as to 50 ohms.

The slot line element 100 is capable of operating as a dipole to exhibit directivity along the x, y, or z axis, depending upon the location of the feedpoints. With feedpoints A and B located on the top patches 110-1, 110-2 as shown in FIG. 1A, an "end fire" beam is directed along the z axis (that is, the E-field is along the z axis) as shown in FIG. 1B.

Arbitrary types of polarization such as circular, vertical, or horizontal are possible as described in more detail below.

Figure 2:
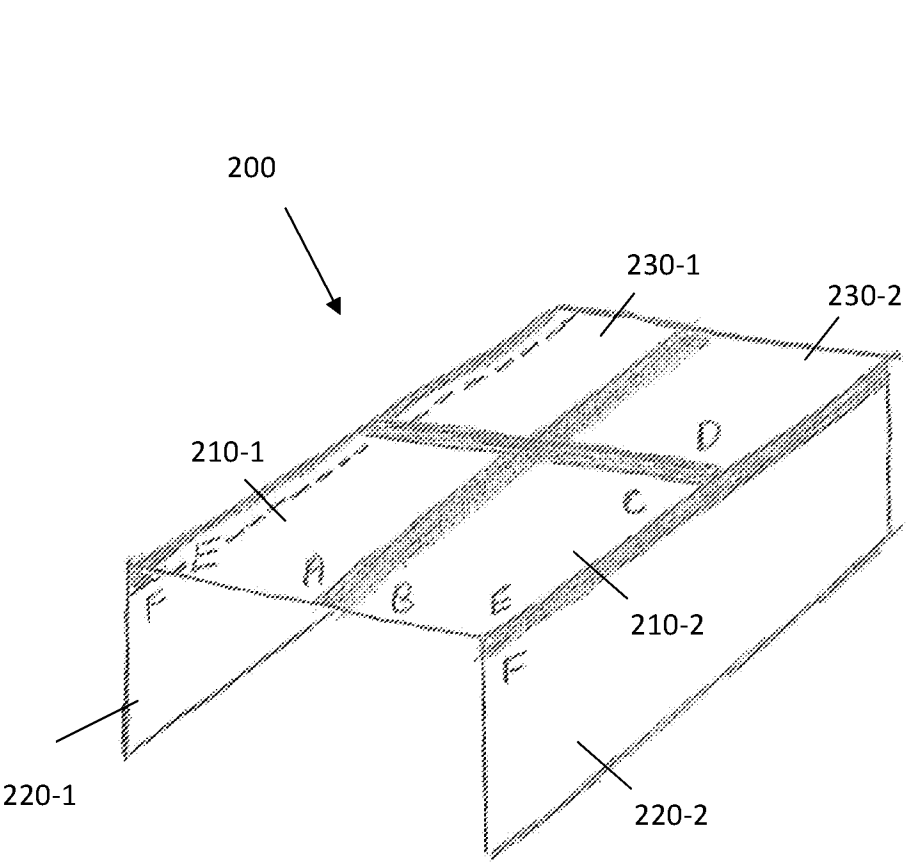
FIG. 2 shows how different feed configurations can be selected to generate fields along different axes.

FIG. 2 shows how radiating beams may be generated along the x, y, or z axes with a slightly different configuration for the volumetric antenna element 200. Here there are two patches 210-1, 210-2 arranged in the top plane and two additional patches 230-1, 230-2 also in the top plane, for a total of four patches in the top plane. Side patches 220-1, 220-2 are placed along the orthogonal side planes as in the FIG. 1A configuration. This configuration implements slots (identified by the heavy dark lines) between the six conductive patches. Additional pairs of feedpoints C,D are provided on patches 210-2 and 230-2 and E,F on patches 210-2, 230-2 as shown. PIN diodes or similar shorting control circuits are coupled across the slots to select feedpoints A,B C,D or E,F as the active feedpoints.

As the table to the left in FIG. 2 indicates, selection of feedpoints A,B generates an E-field field along the z-axis, selection of feedpoints C,D generates a field along the x-axis, and selection of feedpoints E,F generates a field along the y-axis.

The slot line volumetric element 100 or 200 is uniquely suited be arranged into arrays to create traveling wave structures. Each element is a radiating slot line, which permits every element to act as a feed line for the next element in the sequence. This property eliminates the need for a separate transmission line usually associated with traveling wave antennas.

Figure 3:
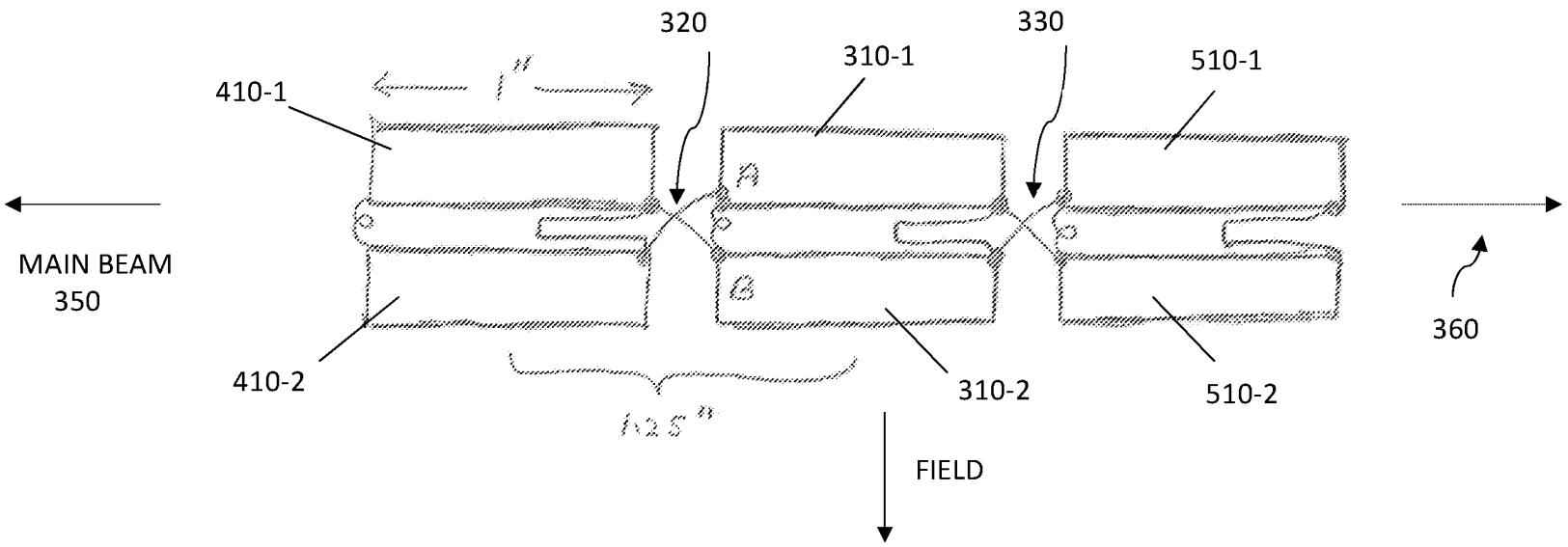
FIG. 3 is a three-element end-fire array.

One such array, a three element unidirectional endfire array working at 2.45 GHz for WiFi applications is shown in FIG. 3. FIG. 3 is a top view showing only the patches 310-1, 310-2, 410-1, 410-2, 510-1, 510-2 disposed in the top plane; corresponding side patches for each element are not shown. A pair of crossover connections 320 are provided between adjacent ends of patches 310-1, 410-2 as well as between patches 310-2,410-1. A corresponding pair of crossover connections 330 are provided between adjacent ends of patches 310-1, 510-2 and patches 310-2, 510-1. The result excites currents on the patch elements with relative delay depending upon their relative distance from the feedpoints along the length dimension of the array. The resulting fields (generated in the indicated direction when fed from the A,B points) from each element coherently combine to create a main antenna beam 350 in the indicated direction (that is, towards the left in FIG. 3). A prototype constructed with the indicated element spacing of 1.25 inches exhibited a bandwidth of 325 MHz, and measured gain of 4 dBi in free space, which is expected to be about 3.2 dBi when mounted on the side of a tablet computer housing.

The direction of the main beam 350 is controlled by the location of the feedpoints A,B. For example, a end fire beam in the opposite direction (towards the right in FIG. 3 as indicated by the dotted arrow 360) can be generated by instead using feedpoints A', B' located on the opposite ends of patches 310-1, 310-2.

While an end fire array is shown in FIG. 3, it should be understood that a broadside feed arrangement is also possible, which generates beams along other axes. As with the volumetric elements described in the above-referenced U.S. patent application Ser. No. 15/362,988, arrays of elements can be placed around all four corners of a wireless device housing to provide beams in different directions.

Horizontal, vertical and other polarization modes can also be provided with feed networks coupled to the A,B, C,D or E,F feedpoints. See the combining networks in issued U.S. Pat. Nos. 9,118,116 and 9,013,360. Another approach to providing polarization modes is described in detail below.

While the depicted arrangements use two patches arranged in a cross-sectional U-shape, it should be understood that other shapes may be effective, such as L-shapes.

It is also possible to insert delay elements, meanderlines or other structures at the crossover/feed points to further assist with resonant tuning at lower frequency ranges.

We have found that this arrangement is relatively insensitive to the presence of nearby dielectric structures such as the hand of a user. This is because the driven A, B patches are oppositely exited (180 degrees out of phase).

Figure 4:
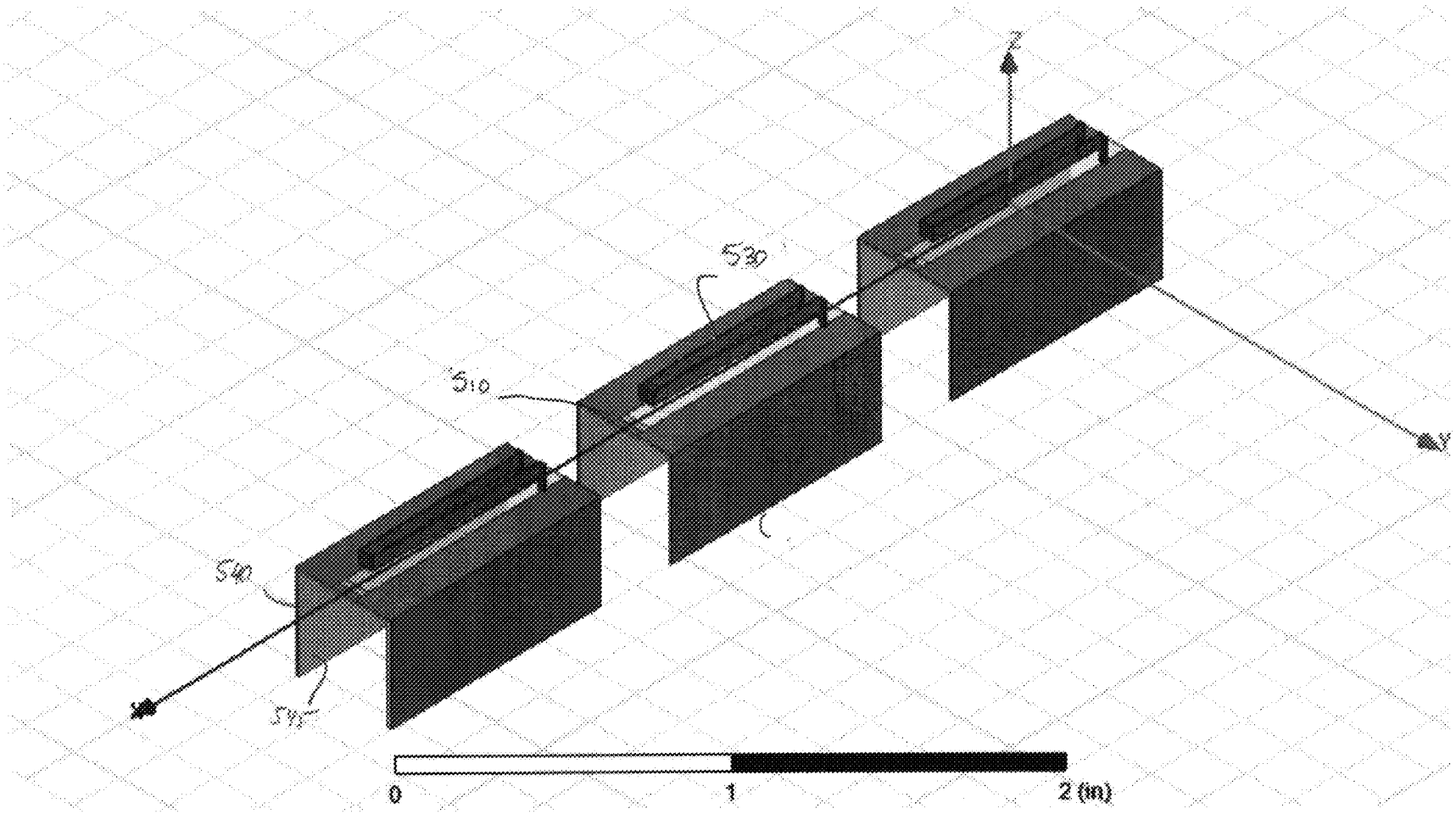
FIG. 4 is an isometric view of a model of the three element array.
Figure 5:
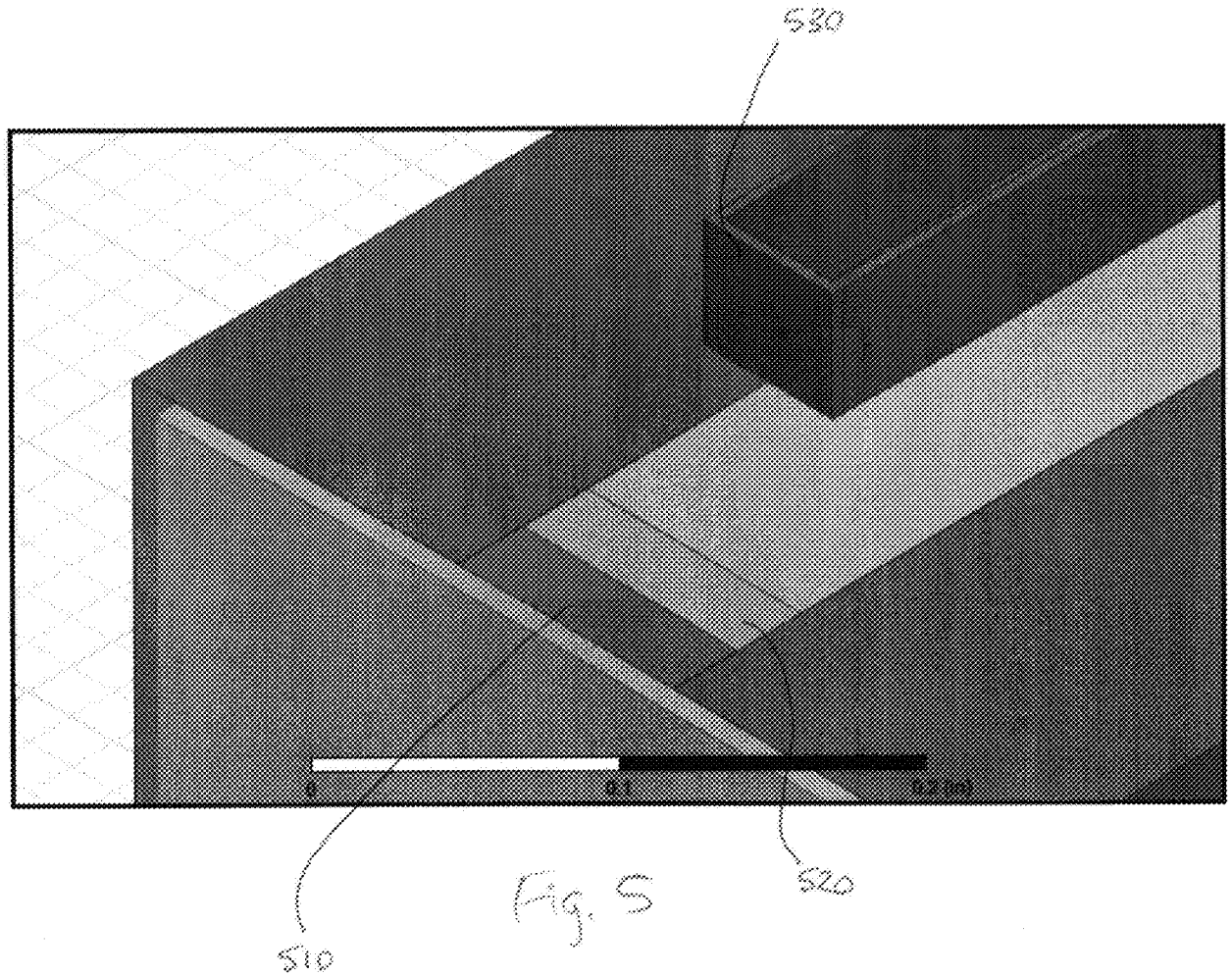
FIG. 5 is a more detailed view of the model.

An High Frequency Electromagnetic Field Simulation (HFSS) model of a three element array was created. FIG. 4 is an isometric view of the model, with FIG. 5 a close up view of the feed end showing the feedpoint 510, inductor 520 (here set to 2 nH) and hairpin connection 530. The patches 540 and hairpins 530 were modeled as copper conductive material; the patches were placed over a dielectric substrate formed of RO3003 of 10 mil thickness. (Crossover points were modelled but are not shown in these figures).

Figure 6A:
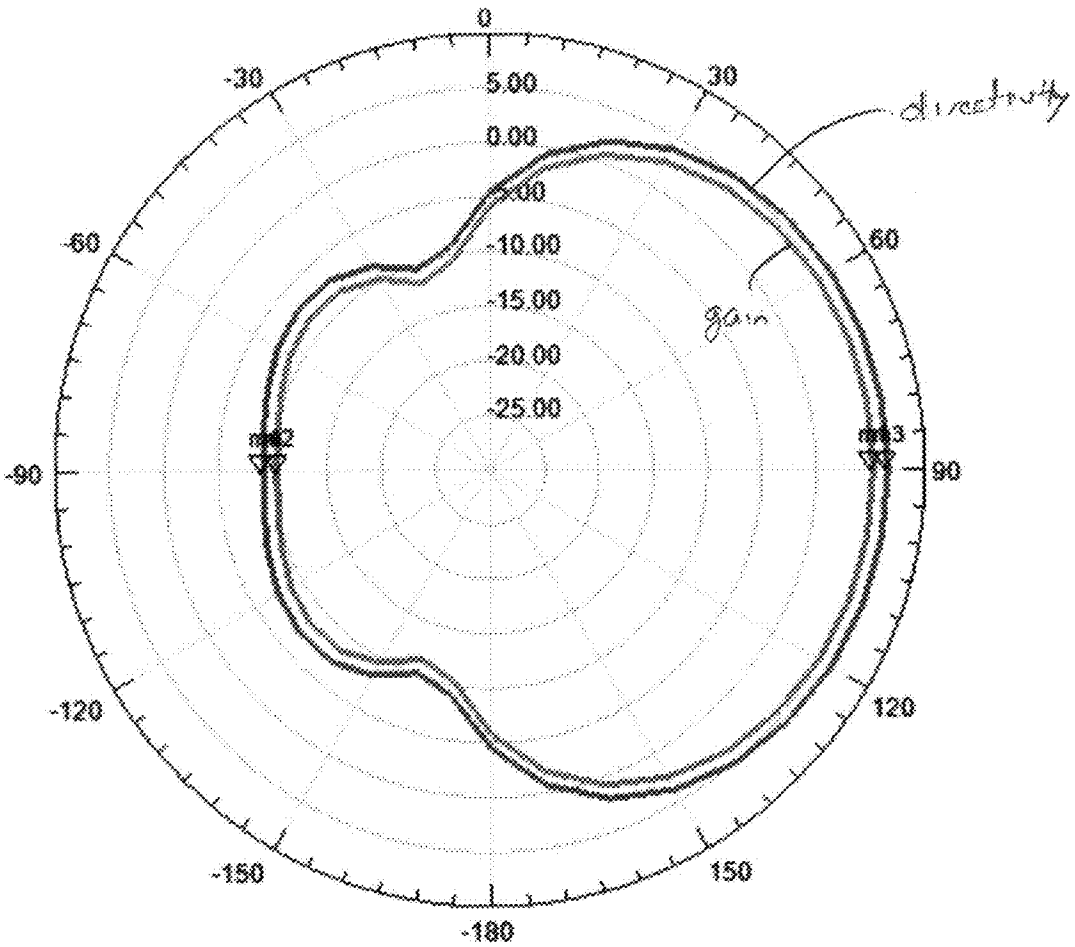
FIGS. 6A and 6B are azimuth and elevation patterns.
Figure 6B:
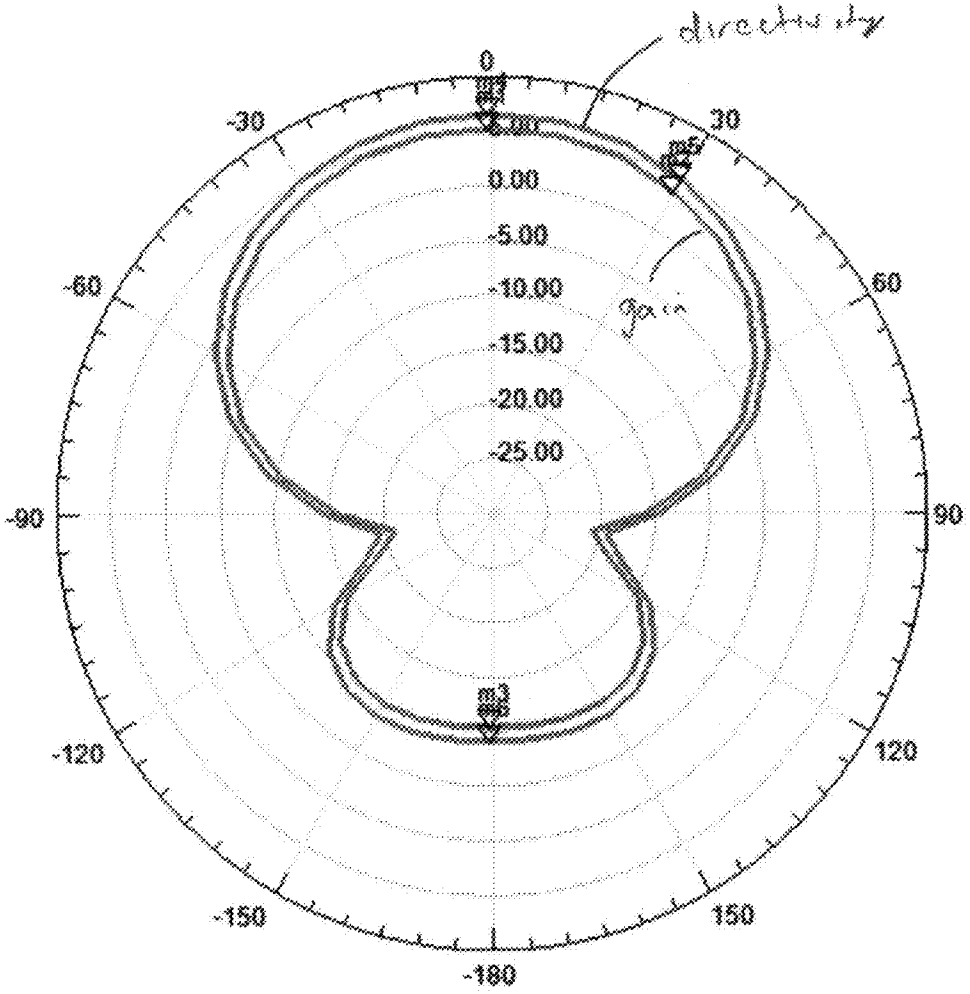

The resulting elevation and azimuth pattern plots for operation at 2.45 GHz are shown in FIGS. 6A and 6B respectively. Directivity and gain plots are shown; peak gains of 5 dBi are predicted by the simulation.

Figure 7:
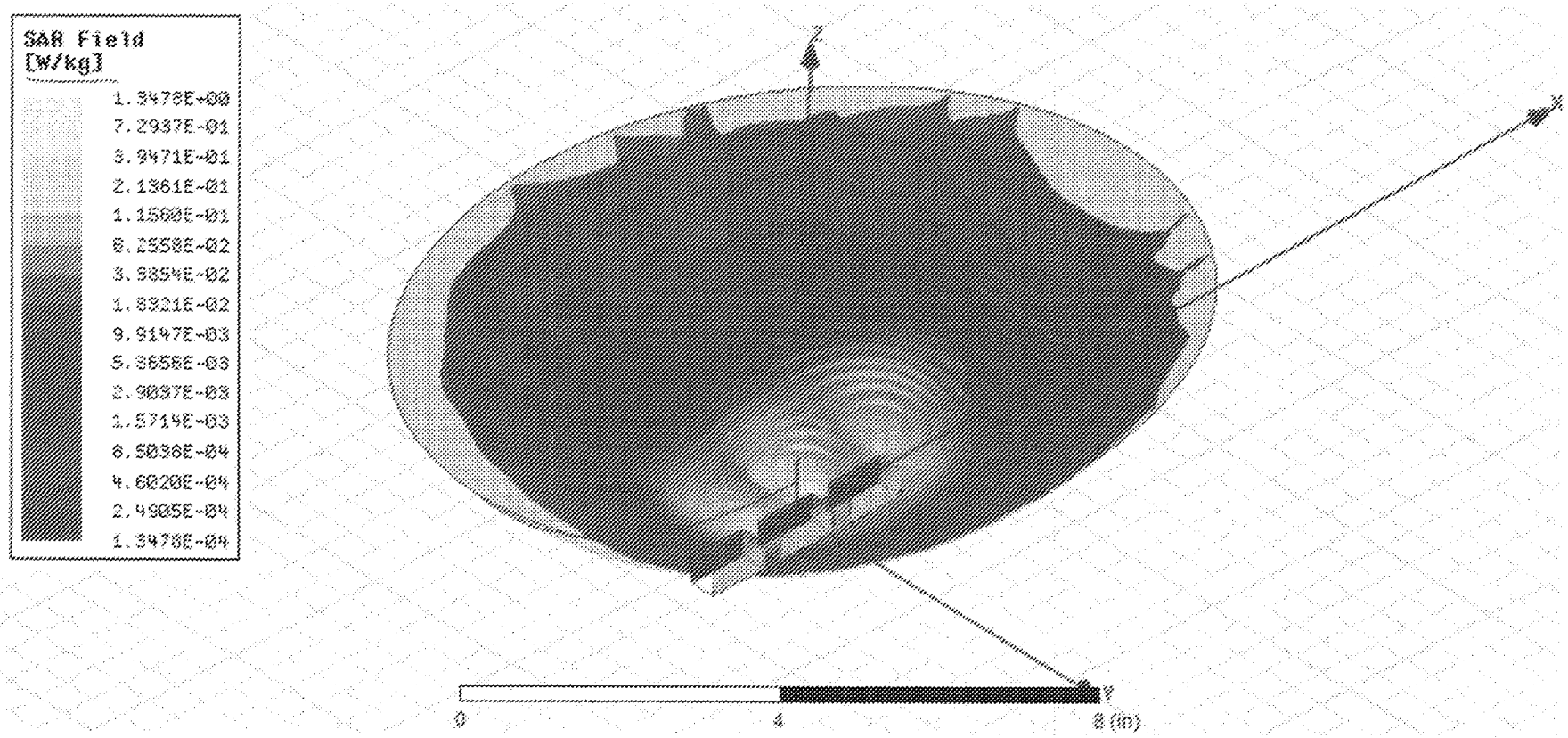
FIG. 7 illustrates expected SAR performance.

It is also expected that the design will meet Specific Absorption Rate (SAR) emission requirements for mobile devices promulgated by the U.S. Federal Communications Commission (FCC) and other agencies. FIG. 7 is a plot of the expected SAR emissions predicted by the mode (in watts/kg); emissions were determined at a distance of 2 mm from a person's head.

(THE FOLLOWING DISCUSSION OF POLARIZATION WAS TAKEN FROM THE "JUICY FRUIT" PATENT APPLICATION. IS THIS THE MOST RELEVANT WAY?)

Figures 8A, 8B:
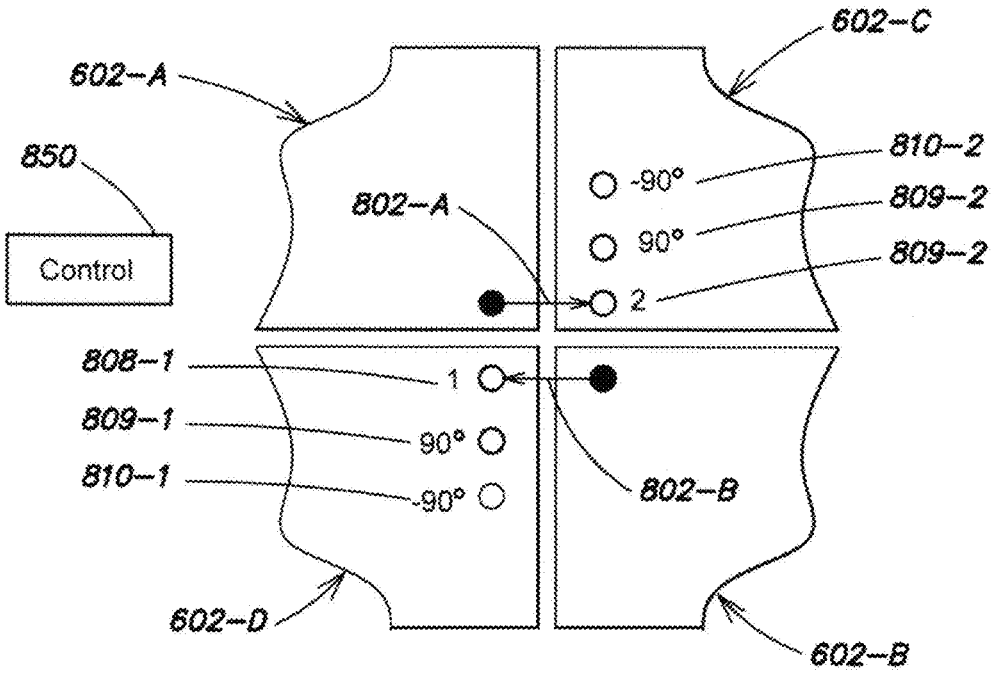
FIGS. 8A and 8B illustrate selectable polarization with a pair of feedpoints.

The line array may also provide different polarizations such as circular (either right-hand or left-hand), vertical, horizontal, or a combination of some or all of such polarizations. FIGS. 8A and 8B illustrate how different combining networks may be implemented to provide these different polarization modes. The two crossed dipole patches 602-A, 602-B, and 602-C, 602-D shown here correspond to the patches 310-1, 410-2 and 410-1, 310-2 that were shown in FIG. 3. Switches 802-A and 802-B provide the ability to selectively control a first dipole (formed by patches 602-A, 602-B). These switches connect the feed points to different locations on the adjacent patches. For example, switch 802-A permits connecting the feed for patch 604-A to one of three different positions on adjacent patch 602-C including positions 808-2, 809-2 and 810-2, and a fourth position 808-1 on patch 602-D. Similarly, switch 802-B selectively connects the feed point on patch 602-B to one of three positions 808-1, 809-1 and 810-1 on patch 602-D or to point 808-2 on patch 602-C. Points 809-1 and 809-2 are connected to their respective patch through a 90° phase shifter. Points 810-1 and 810-2 are connected to the respective patch though a −90° phase shifter.

The table of FIG. 8B shows four different selectable positions for each switch 802-A, 802-B and the resulting polarizations, in the E-plane and H-plane. For example, placing switch 802-A in position 2 (connecting it to point 808-2) and switch 802-B connected to position 1 (connecting to point 808-1) provides horizontal polarization in the E-plane and vertical polarization in the H-plane. With switch 802-A in position 808-1 and switch 802-B in position 808-2, the opposite horizontal and vertical polarizations are provided. Switch positions selected for the 90° phase shifters or −90° phase shifters provide, respectively, right-hand circular polarization or left-hand circular polarization.

FIGS. 8A and 8B thus illustrate how the conductive patches may provide different polarizations. The adjacent parasitic elements (those not connected to feedpoints A,B) are similarly controlled by digital controller 850 (with the understanding the feed points A and B are not connected to driving circuitry).

Analogous operation may also be provided for the other C, D and E, F active feed configurations to provide polarization for operating in the other two axes.

Controller 850 may include digital logic circuits, a gate array, a programmable microprocessor, a digital signal processor, or other circuits that control the state of the switches 802. In certain embodiments, the selection of vertical, horizontal, or circular polarization state may depend upon a detected operating environment. In one example, the controller 850 may try various possible polarizations in an initial mode. The polarization mode with the highest receive power is then selected by the controller 850 for subsequent operation. In other embodiments, the circular polarization may be selected when other sensors indicate that device is in motion. Such an input may come from an accelerometer, GPS or other sensor that provides inputs to the controller 850. In another mode, a scan of different directions may be used to indicate that the device is in a multipath environment. For example, if strong signals are received from two or more directions, then the device can be operated as if it is in an urban environment. In that case, the vertical polarization mode may be enabled by the controller. However, if multipath is not detected, then horizontal polarization may be enabled.

What is claimed is:

1. An antenna comprising:

a first pair of rectangular conductive material patches disposed in a first top plane, the patches spaced apart by a slot, a second pair of conductive material patches, each one of the second pair of patches adjacent a corresponding one of the first pair of conductive patches and disposed in a respective left or right side plane orthogonal to the first plane and on either side of the slot, a first feed point, A, provided at one end of a selected one of the first pair of patches, a second feed point, B, provided opposite the slot from feed point A and on a corresponding end of the other one of the first pair of patches, a hairpin stub coupled to the far ends of the first pair of patches away from the A, B feed points, and an inductor disposed across the slot between the A, B feed points, a third pair of conductive material patches disposed in the same top plane as the first pair, each spaced apart from a respective one of the first pair of patches to form a second slot;

the second pair of patches spaced apart from both the first and third pair of patches with two slots thus formed between the top plane and adjacent a respective one of the left and right side planes: and a third feed point, C, provided on one of the first pair of patches; and a fourth feed point, D, provided opposite feed point C in one of the third pair of patches.

2. The antenna of claim 1 further comprising:

a fifth feed point, E, provided on one of the first pair of patches located adjacent the slot between a selected one of the second pair of patches on the side planes; and a sixth feed point, F, provided opposite feed point E in the selected one of the second pair of patches.

3. The antenna of claim 2 further comprising:

a polarization combining network coupled to selected ones of feed points A and B, or feed points C and D, or feed points E and F.

4. The antenna of claim 1 further comprising:

a second hairpin stub coupled across one end of the third pair of conductive material patches;

an inductor disposed across an opposite end of the third pair of conductive material patches.

5. The antenna of claim 1 further comprising:

a polarization combining network coupled to feed points A and B.

6. The antenna of claim 5 further comprising:

a controller for operating the polarization combining network to provide one or more of horizontal, vertical, right-hand circular or left-hand circular polarization.

* * * * *